US005277949A

United States Patent [19]

Green

[11] Patent Number: 5,277,949

[45] Date of Patent: Jan. 11, 1994

[54] FRAME WITH GLASS ON BOTH SIDES FOR ATHLETIC MINIATURES AND SPORTS MEMORABILIA

[76] Inventor: Neil L. Green, 18301 San Fernando Mission Blvd., Northridge, Calif. 91326

[21] Appl. No.: 688,860

[22] Filed: Apr. 22, 1991

[51] Int. Cl.[5] ..... G09F 19/00

[52] U.S. Cl. ..... 428/13; 428/542.4

[58] Field of Search ..... 428/13, 542.4; D6/471; 206/315.1; 40/152

[56] References Cited

U.S. PATENT DOCUMENTS

| | | | |
|---|---|---|---|
| D. 293,220 | 12/1987 | Pierce | 428/542.4 X |
| 1,895,818 | 1/1933 | Regan | 40/152 |
| 3,589,049 | 6/1971 | Cornelius | 40/152 |
| 3,651,598 | 3/1972 | Lang | 428/542.4 X |
| 4,261,122 | 4/1981 | Le Vine | 40/155 X |
| 4,290,216 | 9/1981 | Gale | 40/152.1 |
| 4,530,863 | 7/1985 | Seeger | 428/13 |
| 4,777,745 | 10/1988 | Rose | 40/152 |
| 4,779,368 | 10/1988 | Thede | 40/152.1 |
| 4,831,754 | 5/1989 | Tallent | 40/152 |
| 4,850,125 | 7/1989 | Green | 40/152 |
| 4,995,508 | 2/1991 | Burley | 206/44 B |
| 5,118,171 | 6/1992 | Ortiz | 312/204 |

*Primary Examiner*—Henry F. Epstein
*Attorney, Agent, or Firm*—Thomas I. Rozsa; Dong Chen

[57] ABSTRACT

A frame for athletic miniatures and sports memorabilia having a double-sided frame made of wooden material with glass members on both sides, and a stiffening board for supporting an athletic miniature or sports memorabilia assembled between the glass members, so that the athletic miniature or sports memorabilia can be viewed through the glass members from both sides of the frame.

18 Claims, 3 Drawing Sheets

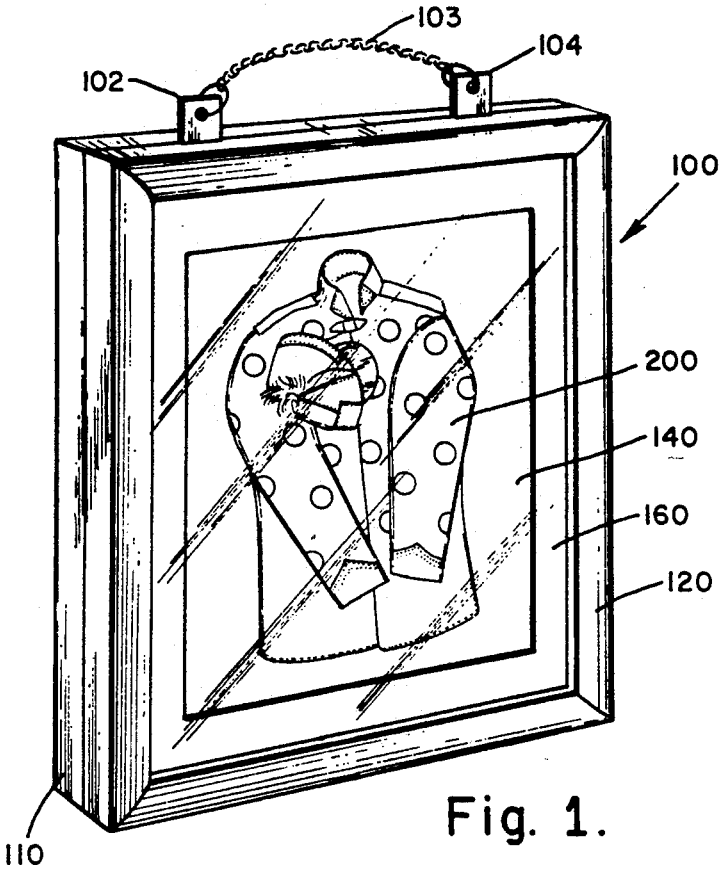
Fig. 1.
Fig. 2.
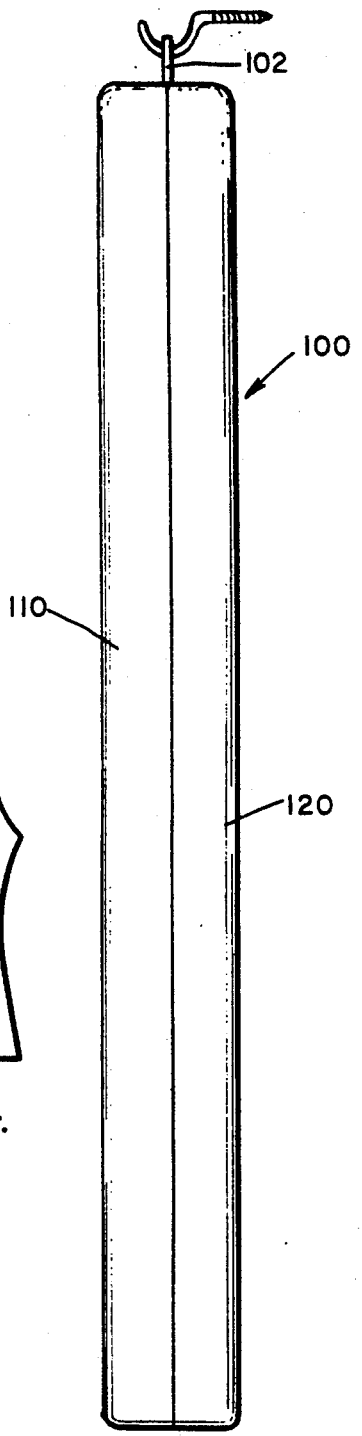
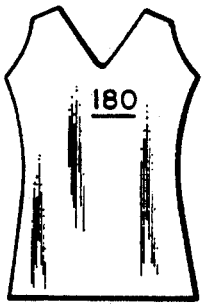
Fig. 4.
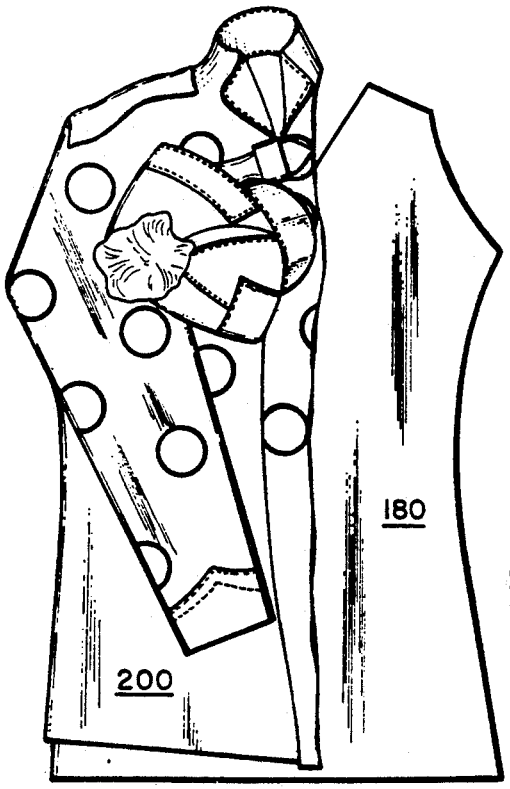
Fig. 3.

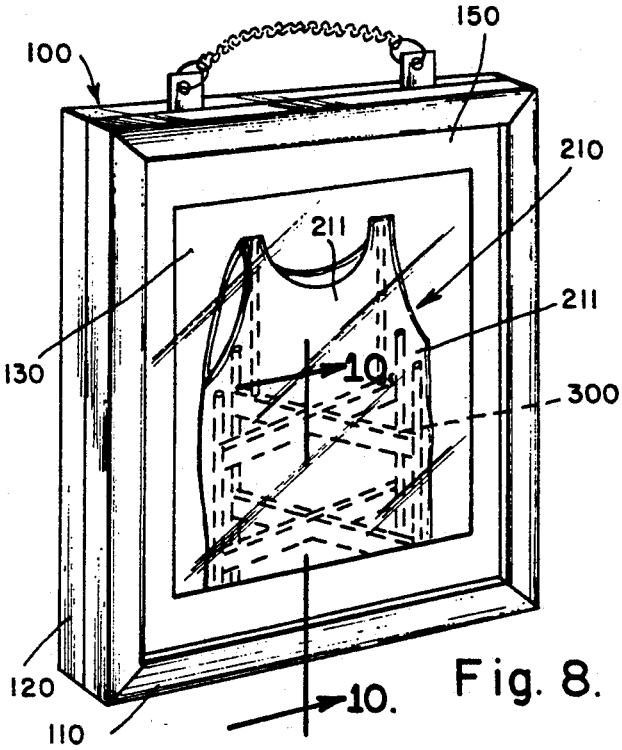
Fig. 8.
Fig. 11.
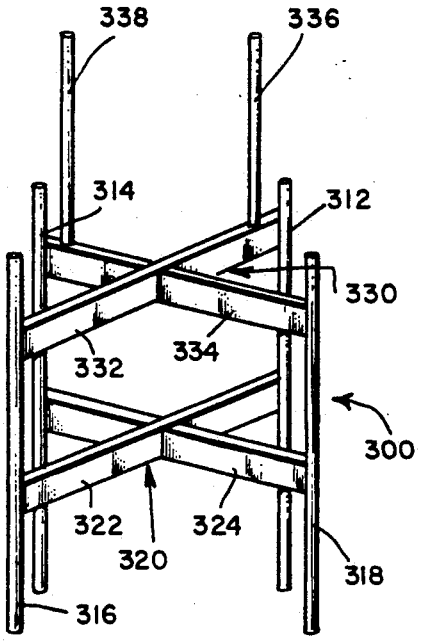
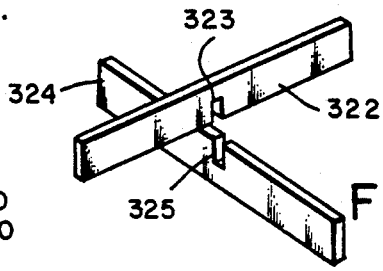
Fig. 12.
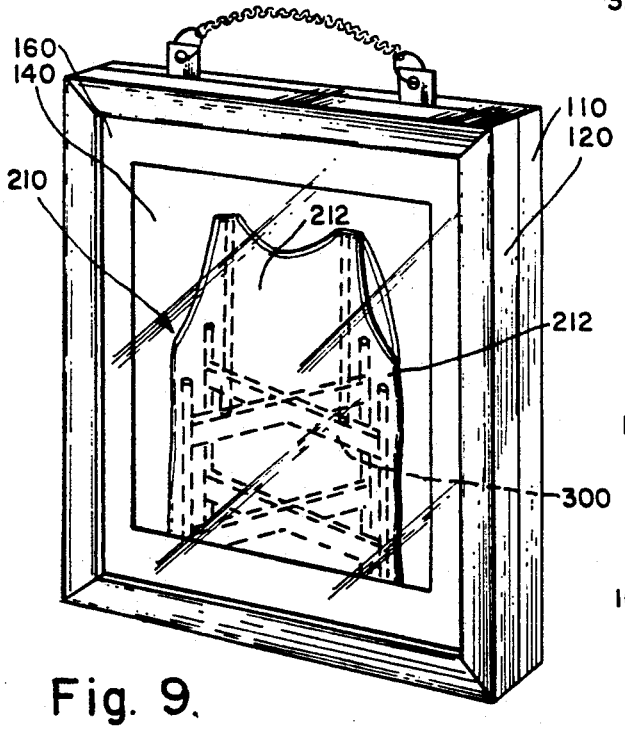
Fig. 9.
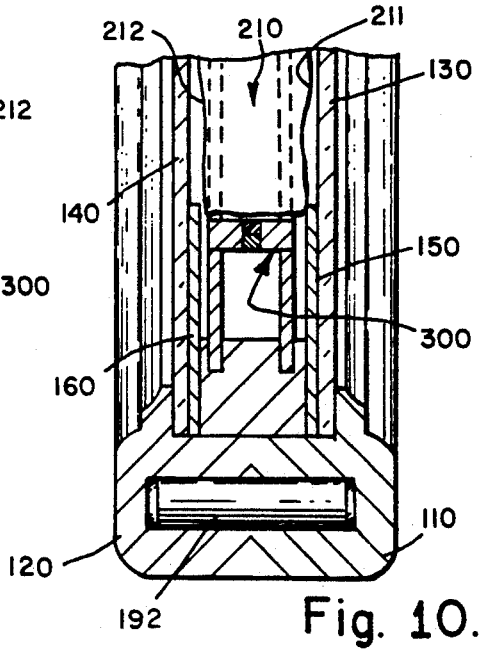
Fig. 10.

FRAME WITH GLASS ON BOTH SIDES FOR ATHLETIC MINIATURES AND SPORTS MEMORABILIA

BACKGROUND OF THE INVENTION

1. Field of the Invention

The present invention relates to the field of showcases for collection of sports trophies. More particularly the present invention relates to the field of special frames in different sizes for containing and exhibiting athletic miniatures as well as athletic memorabilia of various sizes in full life size duplicates.

2. Description of the Prior Art

It has been a long-time popular hobby for people to collect sports trophies for preserving memorabilia and recapturing precious moments of great, exciting and historical sports events. In particular, there are many people who collect clothing worn by famous athletes and equipment used in major sports events. For example, many baseball fans collect major league baseball memorabilia such as baseballs, bats, caps, gloves and uniform jerseys. These sports object collections are usually contained in some kind of showcase for both protection and presentation.

A typical sports trophy showcase has a solid wooden frame, a piece of glass, one or several padding pieces and a back panel. A sports object is first affixed to the back panel, then the back panel and the piece of glass are assembled in the frame with one or several padding pieces so that the sports object can be viewed through the glass while protected by the frame against dust or distortion. The frame may be hung on the wall or placed on a stand.

Over the years there are also many people who collect athletic miniatures. One reason people collect athletic miniatures is that the original athletic uniforms are limited and not available to everyone. Athletic miniatures are made exactly like the real athletic objects in every detail, only smaller in size. Some athletic miniatures are even made of the same material as the full-size original. They are contained in customized frames which are similar to the larger frames described above.

The frames for athletic miniatures and other sports memorabilia of various sizes currently used have one disadvantage. Take a miniature of a uniform jersey of a famous athlete for example. The real uniform jersey may have the athlete's name and number printed on the back and the name of the athlete's team printed on the front. To make it look authentic, the miniature jersey also has the same printing on both the front and the back. However when placed inside a frame with only glass on the front side, only the front of the miniature jersey is visible since the back of the miniature jersey is affixed to the back panel of the frame. It is desirable to have a frame for athletic miniatures which not only shows the front, but also the back of the athletic miniatures. It is also desirable to have a frame for full size athletic jerseys which also shows the front and back of the jerseys, and also a compatible frame for larger than regular sized athletic jerseys.

SUMMARY OF THE PRESENT INVENTION

The present invention is a frame with glass on both sides for athletic miniatures and sports memorabilia of various sizes.

It is known that many people collect sports trophies, athletic miniatures and other sports memorabilia of various sizes. The collections are usually contained in frames for both protection and presentation. A frame often has a back panel for affixing and holding a trophy or miniature, one or several optional padding pieces, a piece of glass and a solid frame, all assembled together. A problem with the current frame for athletic miniatures or sports memorabilia front view of the object is visible and people cannot see the back of the object which often has interesting printing different from the printing on the front of the object.

It has been discovered, according to the present invention, that if a new frame for an athletic miniature or other sized replication of a sports object has glass on both the front and the back sides, then both the front and the back of the athletic miniature or other sports objects will be visible.

It has also been discovered, according to the present invention, that if the new frame is made of transparent material on both the front and back sides, then the traditional non-transparent back panel for supporting the athletic miniature or other sports object has to be removed.

It has further been discovered, according to the present invention, that if the new frame with glass on both sides has an inner customized stiffening means, then an athletic miniature, or other sized sports object, made of flexible material such as a miniature uniform jersey, or a regular sized jersey, can be supported without the traditional back panel.

It is therefore an object of the present invention to provide a new frame for an athletic miniature or other sized sports object, which has glass on both the front and the back sides, so that both the front and the back of the athletic miniature or other sports object will be visible.

It is an additional object of the present invention to provide a new frame for an athletic miniature or other sized sports object without a traditional non-transparent back panel so the new frame is transparent as seen from both the front and back sides of the frame.

It is a further object of the present invention to provide a new frame with glass on both sides for athletic miniatures or other sized sports objects having an inner customized stiffening means, so that an athletic miniature, or other sized sport object, made of flexible material such as a miniature uniform jersey, or a regular jersey, can be supported without the traditional back panel.

It is an additional object of the present invention to provide different sized new special frames with glass on both sides, so that not only usually small sized athletic miniatures, but also other various sized, including regular sized, sports memorabilia can be contained and exhibited.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view showing a preferred embodiment of the present invention frame for athletic miniatures and sports memorabilia of various sizes.

FIG. 2 is an end view of the preferred embodiment of the present invention frame.

FIG. 3 is a perspective view showing a miniature cloth supported by a stiffening board which may be assembled inside the present invention frame.

FIG. 4 is a front view of the stiffening board.

FIG. 8 is a perspective view of the first side of the present invention frame where the front side of a miniature team jersey supported by an alternative stiffening means can be viewed.

FIG. 9 is a perspective view of the second side of the present invention frame where the back side of a miniature team jersey supported by the alternative stiffening means can be viewed.

FIG. 10 is a cross-sectional view taken along line 10—10 of FIG. 8.

FIG. 11 is a perspective view of the alternative stiffening means of the present invention frame for athletic miniatures.

FIG. 12 is a perspective view of one of the transversal cross members of the alternative stiffening means of the present invention frame for athletic miniatures.

DETAILED DESCRIPTION OF THE PREFERRED EMBODIMENT

Figure 5:
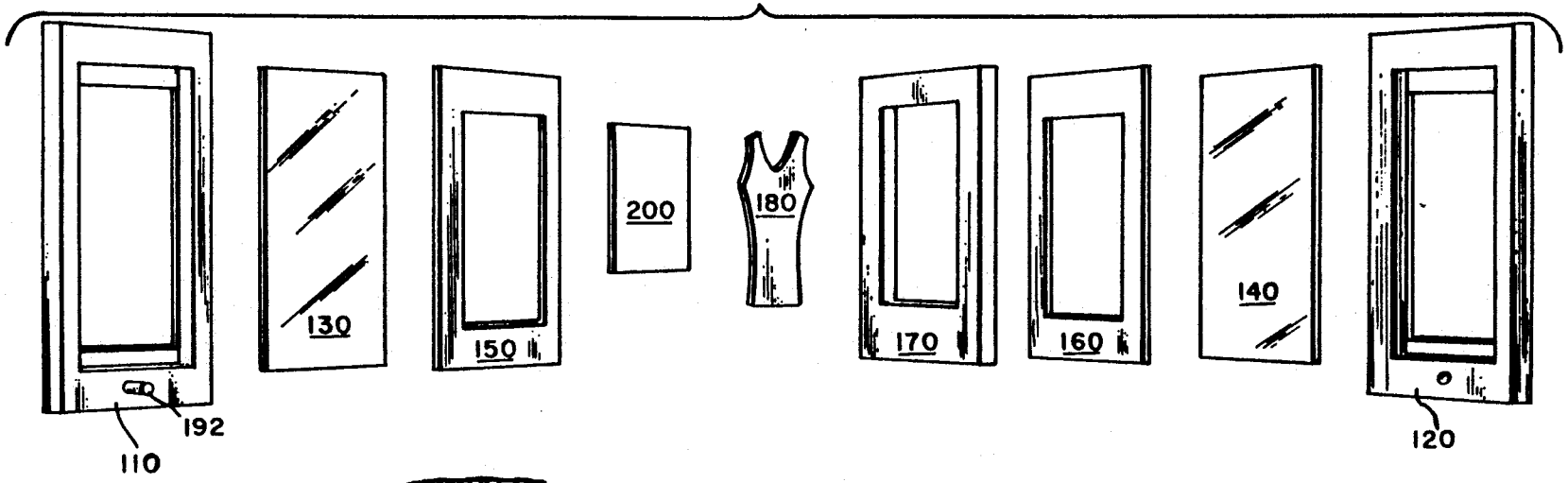
FIG. 5 is an exploded view of the preferred embodiment of the present invention frame shown in FIG. 1.

Although specific embodiments of the present invention will now be described with reference to the drawings, it should be understood that such embodiments are by way of example only and merely illustrative of but a small number of the many possible specific embodiments which can represent applications of the principle of the present invention. Various changes and modifications obvious to one skilled in the art to which the present invention pertains are deemed to be within the spirit, scope and contemplation of the present invention as further defined in the appended claims.

Referring to FIG. 1, there is shown at 100 a frame of the present invention for holding and displaying a miniature cloth 200. At the top of frame 100, there are two hanging members 102 and 104 such as small round hook eyes for hanging frame 100 onto a wall. Additionally, optional chain 103 can be used to suspend the frame from a wall or from an upper area such as a shelf or ceiling. Frame 100 has two rectangular shaped rigid frame members 110 and 120 assembled together. By way of example, frame members 110 and 120 may be made of wooden material such as solid oak. Frame members 110 and 120 may also be made of plastic material or light metal material such as aluminum. From the side of frame member 120 there can be seen a rectangular shaped transparent window member 140 and a rectangular shaped hard padding member 160 inside. Miniature 200 is held and displayed inside frame 100. Transparent window member 140 may be made of glass or clear plastic material. Hard padding member 160 may be made of hard paper boards or thick foam-like fabric or nylon materials. FIG. 3 shows that miniature cloth 200 is supported by inserting a customized stiffening means 180 into miniature cloth 200. FIG. 4 shows one embodiment of stiffening means 180 which is a thin board and may be made of soft wooden material, styrofoam, or hard paper board, or other thick foam-like materials.

The embodiment of customized stiffening means 180 shown in FIG. 4 is suitable for supporting miniature cloth made of thick fabric material. A miniature of certain uniform jerseys such as a horse racing jockey's silks is usually made of thick fabric material because its full size original product is made of thick fabric material. Sometimes a miniature is made of thin fabric material and a thin stiffening board is no longer suitable because even with the stiffening board inside, it is still not thick enough to fill the space inside the frame. For example, a team shirt is usually made of thin fabric material, so its miniature is also made of thin fabric material to make the miniature look like the full size shirt in detail. It is not large enough to fill the space within the frame if the thin stiffening board is used again to support the miniature shirt. A different embodiment of the stiffening means may be used in this case as discussed later.

Figure 6:
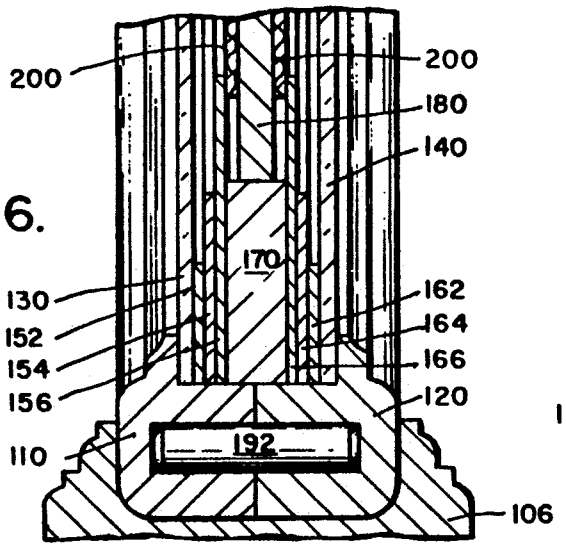
FIG. 6 is a cross-sectional view taken along line 6—6 of FIG. 7.

FIG. 5 is an exploded view of the preferred embodiment of the present invention frame shown in FIG. 1. From the left to the right there is shown a first rectangular shaped rigid frame member 110, a first rectangular shaped transparent window member 130, a first rectangular shaped hard padding member 150 which has a rectangular shaped central opening, a miniature cloth 200, a customized stiffening means 180, a third rectangular shaped rigid frame member 170, a second rectangular shaped hard padding member 160 which also has a rectangular shaped central opening, a second rectangular shaped transparent window member 140 and a second rectangular shaped rigid frame member 120. All the pieces are assembled together symmetrically as shown in FIG. 6. By way of example, first frame member 110, second frame member 120 and third frame member 170 are made of hard wooden materials such as solid oak. First transparent window member 130 and second transparent window member 140 are made of glass. Stiffening means 180 is made of hard paper board or styrofoam. Stiffening means 180 is inserted inside miniature cloth 200, and placed within the frame of third frame member 170, right on the bottom edge of third frame member 170. A first attaching means may be used to secure stiffening means 180 to third frame member 170. The first attaching means may comprise several metal pins such as 182 and 184. A second attaching means is used to secure first frame member 110 and second frame member 120 together. Second attaching means may comprise several wooden dowels. In FIG. 6 one of the dowels is shown at 192.

One unique feature of the present invention stiffening means 180 supported in this manner is that it enables the miniature cloth 200 to be free standing within the frame and not be maintained in its regular position through a requirement that the miniature cloth 200 be pressed between the two window members 130 and 140 or any other pressure to hold it in place.

In one of the preferred embodiments, first padding member 150 and second padding member 160 each have three rectangular shaped thin pads with rectangular shaped central openings as shown by the cross-sectional view of FIG. 6. All these thin pads may be made of hard paper boards. First padding member 150 has three thin pads 152, 154 and 156. First pad 152 is assembled adjacent to first window member 130, third pad 156 is assembled adjacent to third frame member 170, and second pad 154 is assembled between pads 152 and 154. All three pads 152, 154 and 156 have central openings. The central opening of pad 152 is larger than the central opening of pad 154, and the central opening of pad 154 is larger than the central opening of pad 156. The central opening of pad 156 is larger than the planar size of miniature cloth 200 but smaller than the central opening of third frame member 170, so that while miniature cloth 200 can be seen through first window member 130 and first padding member 150, third frame member cannot be seen. Similarly, second padding member 160 also has three thin pads 162, 164 and 166. Fourth pad 162 is assembled adjacent to second window member 140, sixth pad 166 is assembled adjacent to third frame member 170, and fifth pad 164 is assembled between pads 162 and 164. All three pads 162, 164 and 166 have central openings. The central opening of pad 162 is larger than the central opening of pad 164, and the central opening of pad 164 is larger than the central opening of pad 166. The central opening of pad 166 is larger than the planar size of miniature cloth 200 but smaller than the central opening of third frame member 170, so that while the other side of miniature cloth 200 can be seen through second window member 140 and second padding member 160, the third frame member 170 again cannot be seen.

Figure 7:
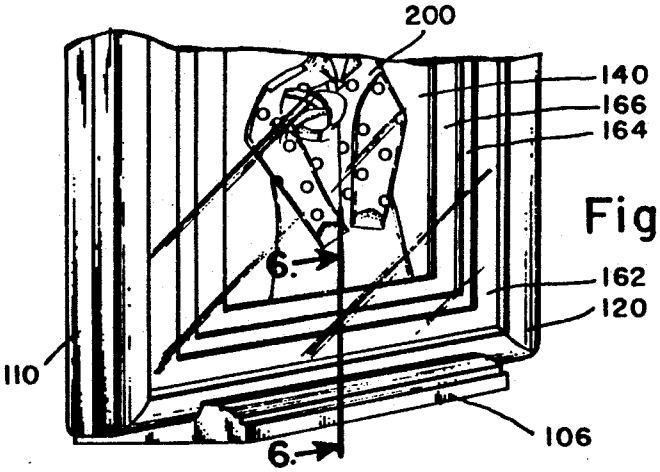
FIG. 7 is a perspective view of the bottom part of an alternative embodiment of the present invention frame.

The three-pad structure is also shown in the perspective in FIG. 7. Viewing through second window member 140 there are fourth pad 162, fifth pad 164 and sixth pad 168 of second padding member 160, and miniature cloth 200 supported by a hidden stiffening means 180 secured on a third frame member 170 which is also hidden from the view. Pads 162, 164 and 166 may have different colors for decoration, as may pads 152, 154 and 156. By way of example, pads 152, 156, 162 and 166 may be white, and pads 154 and 164 may be green. Some of the pads may also be matted pads. The multiple layers and different colors of padding members 150 and 160 provide more elegant appearance. Of course this is just one of the many possible embodiments of the present invention. In other preferred embodiments, the color of the pads may be team colors or racing stable colors to coordinate the jersey and the color scheme accordingly.

FIG. 7 also shows a standing member 106 attached to the bottom of frame 100 so that frame 100 can be placed in an upright position. Stand 106 is also removable and itself is a stationary. It allows the present invention frame to be free standing on a desk top, piano, mantle, or on a shelf of an exhibiting cabinet, and so on. Alternatively the frame may be removed from the stand and hung on a wall or from an upper area of an object by the hanging members 102 and chain 103 shown in FIGS. 1, 8 and 9.

As mentioned earlier, when a miniature is made of thin fabric material, a thin stiffening board is no longer suitable because even with the stiffening board inside, it is still not thick enough to fill the space inside the frame. Such examples include a miniature team shirt usually made of thin fabric material. It is not large enough to fill the space within the frame if the thin stiffening board is used again to support the miniature shirt. An alternative stiffening means 300 shown in FIG. 11 is used for this case. Alternative stiffening means 300 is a three-dimensional structure. When it is inserted inside the miniature shirt, it props up the miniature shirt so that the front piece of the miniature shirt and the back piece of the miniature shirt are spaced apart. This will prevent the miniature shirt from becoming loosened inside the frame and provide a natural wearing configuration appearance.

It will be appreciated that the present invention special frames with glass on both sides may be made in different sizes to fit not only usually small sized athletic miniatures, but also other various sized sports objects, including regular sized sports memorabilia. For example, in some occasions people obtain very valuable real sports team jerseys and want to protect them in frames. In addition people want to be able to view both sides of a real jersey protected in a frame. The present invention provides custom sized frames which fit all collection and exhibition needs.

The alternative stiffening means shown in FIG. 11 is also very useful when the present invention frame is used for containing and exhibiting sports memorabilia which are larger than typical athletic miniatures, such as a regular sized real athletic team jersey, for fully supporting the larger sized object. Since the alternative stiffening means is a three dimensional frame structure which when inserted inside the larger sized object such as a real team jersey will prop-up the jersey, the front and back pieces of the jersey will not nestle next to each other and the two shoulder bands will be supported as well. Therefore, the jersey has the same appearance as when it is being worn.

Referring to FIG. 8, there is shown a perspective view of the first side of the present invention frame 100 where the front piece 211 of a miniature team jersey 210 of regular size supported by alternative stiffening means 300 can be viewed. The second side of the present invention frame 100 is shown in FIG. 9, where the back piece 212 of miniature team jersey 210 supported by alternative stiffening means 300 can be viewed. Alternative stiffening means 300 is shown in dotted lines in both FIGS. 8 and 9. Front piece 211 of miniature team jersey 210 may have the team's name and the athlete's number printed on. Back piece 212 of miniature team jersey 210 has the athlete's name and number printed on. It is highly desirable that both sides of the team jersey can be viewed. The unique feature of the present invention frame with glass on both sides successfully satisfies this desire. FIG. 10 is a cross-sectional view taken along line 10—10 of FIG. 8. It shows that alternative stiffening means 300 is affixed to the third frame member 170 between first padding member 150 and second padding member 160 and supporting miniature team jersey 210, so that front piece 211 of miniature team jersey 210 can be viewed through first window member 130 from the side of first frame member 110 of frame 100, and back piece 212 of miniature team jersey 210 can be viewed through second window member 140 from the side of second frame member 120 of frame 100. Alternative stiffening means 300 props-up inside miniature team jersey 210 so that front piece 211 and back piece 212 of miniature team jersey 210 do not nestle to each other.

Referring to FIG. 11, alternative stiffening means 300 is assembled by four longitudinal rods 312, 314, 316 and 318, and two transversal cross members 320 and 330. Transversal cross member 320 may be assembled by two transversal bars 322 and 324. Transversal bar 322 has a notch 323 at its middle which faces downwardly, and transversal bar 324 has a notch 325 at its middle which faces upwardly. When assembled, notch 323 of transversal bar 322 is clamped onto the middle of transversal bar 324, and notch 325 of transversal bar 324 is clamped onto the middle of transversal bar 322, to therefore form transversal cross member 320. Transversal cross member 330 is formed similarly by transversal bars 332 and 334. In addition, two longitudinal rods 336 and 338 are attached to transversal bars 332 and 334 of transversal cross member 330 respectively, which are used to support the two shoulder parts of miniature team jersey 210 respectively. Of course, alternative stiffening means 300 can have other configurations and assemblies. For example it may be a three-dimensional hanger with similar structure.

It will be appreciated that the present invention special frames with glass on both sides may be made in different sizes to fit not only usually small sized athletic miniatures, but also other various sized sports objects, including regular sized sports memorabilia and larger than life sized sports memorabilia. For example, in some occasions people obtain very valuable real sports team jerseys and want to protect them in frames. Nevertheless people want to be able to view both sides of a real jersey protected in a frame. The present invention provides custom sized frames which fit all collection and exhibition needs.

The alternative stiffening means shown in FIG. 11 is also very useful when the present invention frame is used for containing and exhibiting sports memorabilia which are larger than typical athletic miniatures, such as a regular sized real athletic team jersey, for fully supporting the larger sized object. Since the alternative stiffening means is a three dimensional frame structure which is inserted inside the larger sized object, such as a real team jersey, it will prop-up the jersey. The front and back pieces of the jersey will not nestle next to each other and the two shoulder bands will be supported as well. Therefore the jersey has the same appearance as when it is being worn.

The present invention has many advantageous features including: (1) it frames athletic miniatures or other sports memorabilia inside for full protection; (2) it has glass on both sides so that both sides of the athletic miniature can be viewed; (3) it eliminates the traditional back panel so the frame is transparent, and the miniatures or memorabilia displayed inside is illuminated from both sides which gives a more impressive effect; (4) it has an inner customized stiffening means to support flexible miniatures or memorabilia so they will not wrinkle or fold inside the frame, yet the stiffening means is hidden from the view; (5) it is light-weight, compact in size and made of sturdy material.

Defined in detail, the present invention is a frame for athletic miniatures or sports memorabilia comprising: (a) a first rectangular shaped rigid frame member, a first rectangular shaped hard padding member having a rectangular shaped central opening, and a first rectangular shaped transparent window member assembled between the first frame member and the first padding member; (b) a second rectangular shaped rigid frame member, a second rectangular shaped hard padding member having a rectangular shaped central opening, and a second rectangular shaped transparent window member assembled between the second frame member and the second padding member; (c) a third rectangular shaped rigid frame member assembled between said first padding member and said second padding member; (d) a customized stiffening means for supporting an athletic miniature or sports memorabilia; (e) a first attaching means for securing said stiffening means to said third frame member; and (f) a second attaching means for securing said first frame member and said second frame member together; (g) whereby the athletic miniature or sports memorabilia can be viewed through said first window member and the central opening of said first padding member at one side, and also through said second window member and the central opening of said second padding member at another side.

In the preferred embodiment of the present invention, the frame members are made of solid oak, the padding members are made of hard paper boards, and the transparent window members are made of glass.

In one of the preferred embodiments, the second rectangular shaped hard padding member further comprises: (a) a first thin pad having a large central opening and assembled adjacent to said first window member; (b) a second thin pad having a medium central opening which is smaller than the opening of the first thin pad and assembled adjacent to said first thin pad; and (c) a third thin pad having a small central opening which is smaller than the opening of the second thin pad and assembled adjacent to said second thin pad; (d) whereby said third frame member is hidden from view through said first window member because of said third thin pad.

In one of the preferred embodiments, the first rectangular shaped hard padding member further comprises: (a) a fourth thin pad having a large central opening and assembled adjacent to said second window member; (b) a fifth thin pad having a medium central opening which is smaller than the opening of the fourth thin pad, and assembled adjacent to said fourth thin pad; and (c) a sixth thin pad having a small central opening which is smaller than the opening of the fifth thin pad, and assembled adjacent to said fifth thin pad; (d) whereby said third frame member is hidden from view through said second transparent window member because of said sixth thin pad.

Defined broadly, the present invention is a frame for athletic miniatures or sports memorabilia comprising: (a) a first rigid frame member, a first padding member having a central opening, and a first transparent window member assembled between the first frame member and the first padding member; (b) a second rigid frame member, a second padding member having a central opening, and a second transparent window member assembled between the second frame member and the second padding member; (c) a third rigid frame member assembled between said first padding member and said second padding member; (d) a stiffening means for supporting an athletic miniature or sports memorabilia; (e) a first attaching means for securing said stiffening means to said third frame member; and (f) a second attaching means for securing said first frame member and said second frame member together.; (g) whereby the athletic miniature or sports memorabilia can be viewed through said first window member and the central opening of said first padding member at one side, and also through said second window member and the central opening of said second padding member at another side.

Defined more broadly, the present invention is a frame for athletic miniatures or sports memorabilia comprising: (a) a double-sided frame having transparent window members on both sides; and (b) a stiffening means for supporting an athletic miniature or sports memorabilia assembled between said window members; (c) whereby the athletic miniature or sports memorabilia can be viewed through said window members from both sides of said frame.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A frame for athletic miniatures comprising:

a. a first rigid frame member, a first padding member having a central opening, and a first transparent window member assembled between the first rigid frame member and the first padding member;

b. a second rigid frame member, a second padding member having a central opening, and a second transparent window member assembled between the second rigid frame member and the second padding member;

c. a third rigid frame member assembled between said first padding member and said second padding member;

d. a thin customized stiffening board inserted inside said athletic miniature, the thin stiffening board for supporting said athletic miniature;

e. a multiplicity of metal pins for securing said thin customized stiffening board to said third rigid frame member; and f. a multiplicity of wooden dowels for securing said first rigid frame member and said second rigid frame member together;

g. whereby when said frame is assembled said athletic miniature can be viewed through said first window member and said central opening of said first padding member at one side, and also through said second window member and said central opening of said second padding member at another side.

2. A frame for athletic miniatures in accordance with claim 1 wherein said first rigid frame member, said second rigid frame member and said third rigid frame member are made of solid oak.

3. A frame for athletic miniatures in accordance with claim 1 wherein said first padding member and said second padding member are made of hard paper boards.

4. A frame for athletic miniatures in accordance with claim 1 wherein said first transparent window member and said second transparent window member are made of glass.

5. A frame for athletic miniatures in accordance with claim 1 wherein said thin customized stiffening board is made of soft wooden material.

6. A frame for athletic miniatures comprising:

a. a first rectangular shaped rigid frame member, a first rectangular shaped hard padding member having a rectangular shaped central opening, and a first rectangular shaped transparent window member assembled between the first frame member and the first padding member;

b. said first rectangular shaped hard padding member further comprising, (i) a first thin pad having a large central opening and assembled adjacent to said first rectangular shaped transparent window member, (ii) a second thin pad having a medium central opening which is smaller than the opening of said first thin pad and assembled adjacent to said first thin pad, (iii) a third thin pad having a small central opening which is smaller than the opening of said second thin pad and assembled adjacent to said second thin pad;

c. a second rectangular shaped rigid frame member, a second rectangular shaped hard padding member having a rectangular shaped central opening, and a second rectangular shaped transparent window member assembled between the second frame member and the second padding member;

d. said second rectangular shaped hard padding member further comprising, (i) a fourth thin pad having a large central opening and assembled adjacent to said second rectangular shaped transparent window member, (ii) a fifth thin pad having a medium central opening which is smaller than the opening of said fourth thin pad, and assembled adjacent to said fourth thin pad, (iii) a sixth thin pad having a small central opening which is smaller than the opening of said fifth thin pad, and assembled adjacent to said fifth thin pad;

e. a third rectangular shaped rigid frame member assembled between said first padding member and said second padding member;

f. a three dimensional frame having four longitudinal rods, a lower transversal cross member and an upper transversal cross member, where the four longitudinal rods are interconnected by the lower and upper transversal cross members, to thereby prop up said athletic miniature to prevent said athletic miniature from becoming loosened inside said frame and further enhance the appearance of said athletic miniature;

g. said three dimensional frame further comprising two longitudinal rods assembled spaced apart onto said upper transversal cross member to further support said athletic miniature;

h. two metal pins for securing said three dimensional frame to said third frame member; and i. four wooden dowels for securing said first frame member and said second frame member together;

j. whereby when said frame is assembled said athletic miniature can be viewed through said first window member and said central opening of said first padding member at one side, and also through said second window member and said central opening of said second padding member at another side.

7. A frame for athletic miniatures in accordance with claim 6 wherein said first rectangular shaped rigid frame member, said second rectangular shaped rigid frame member and said third rectangular shaped rigid frame member are made of solid oak.

8. A frame for athletic miniatures in accordance with claim 6 wherein said first rectangular shaped hard padding member and said second rectangular shaped hard padding member are made of hard paper boards.

9. A frame for athletic miniatures in accordance with claim 6 wherein said first rectangular shaped transparent window member and said second rectangular shaped transparent window member are made of glass.

10. A frame for sports memorabilia comprising:

a. a first rigid frame member, a first padding member having a central opening, and a first transparent window member assembled between the first rigid frame member and the first padding member;

b. a second rigid frame member, a second padding member having a central opening, and a second transparent window member assembled between the second rigid frame member and the second padding member;

c. a third rigid frame member assembled between said first padding member and said second padding member;

d. a thin customized stiffening board inserted inside said sports memorabilia, the thin stiffening board for supporting said sports memorabilia;

e. a multiplicity of metal pins for securing said thin customized stiffening board to said third rigid frame member; and f. a multiplicity of wooden dowels for securing said first rigid frame member and said second rigid frame member together;

g. whereby when said frame is assembled said sports memorabilia can be viewed through said first window member and said central opening of said first padding member at one side, and also through said second window member and said central opening of said second padding member at another side.

11. A frame for sports memorabilia in accordance with claim 10 wherein said first rigid frame member, said second rigid frame member and said third rigid frame member are made of solid oak.

12. A frame for sports memorabilia in accordance with claim 10 wherein said first padding member and said second padding member are made of hard paper boards.

13. A frame for sports memorabilia in accordance with claim 10 wherein said first transparent window member and said second transparent window member are made of glass.

14. a frame for sports memorabilia in accordance with claim 10 wherein said thin customized stiffening board is made of soft wooden material.

15. A frame for sports memorabilia comprising:

a. a first rectangular shaped rigid frame member, a first rectangular shaped hard padding member having a rectangular shaped central opening, and a first rectangular shaped transparent window member assembled between the first frame member and the first padding member;

b. said first rectangular shaped hard padding member further comprising, (i) a first thin pad having a large central opening and assembled adjacent to said first rectangular shaped transparent window member, (ii) a second thin pad having a medium central opening which is smaller than the opening of said first thin pad and assembled adjacent to said first thin pad, (iii) a third thin pad having a small central opening which is smaller than the opening of said second thin pad and assembled adjacent to said second thin pad;

c. a second rectangular shaped rigid frame member, a second rectangular shaped hard padding member having a rectangular shaped central opening, and a second rectangular shaped transparent window member assembled between the second frame member and the second padding member;

d. said second rectangular shaped hard padding member further comprising, (i) a fourth thin pad having a large central opening and assembled adjacent to said second rectangular shaped transparent window member, (ii) a fifth thin pad having a medium central opening which is smaller than the opening of said fourth thin pad, and assembled adjacent to said fourth thin pad, (iii) a sixth thin pad having a small central opening which is smaller than the opening of said fifth thin pad, and assembled adjacent to said fifth thin pad;

e. a third rectangular shaped rigid frame member assembled between said first padding member and said second padding member;

f. a three dimensional frame having four longitudinal rods, a lower transversal cross member and an upper transversal cross member, where the four longitudinal rods are interconnected by the lower and upper transversal cross members, to thereby prop up said sports memorabilia to prevent said sports memorabilia from becoming loosened inside said frame and further enhance the appearance of said sports memorabilia;

g. said three dimensional frame further comprising two longitudinal rods assembled spaced apart onto said upper transversal cross member to further support said sports memorabilia;

h. two metal pins for securing said three dimensional frame to said third frame member; and i. four wooden dowels for securing said first frame member and said second frame member together;

j. whereby when said frame is assembled said sports memorabilia can be viewed through said first window member and said central opening of said first padding member at one side, and also through said second window member and said central opening of said second padding member at another side.

16. A frame for sports memorabilia in accordance with claim 15 wherein said first rectangular shaped rigid frame member, said second rectangular shaped rigid frame member and said third rectangular shaped rigid frame member are made of solid oak.

17. A frame for sports memorabilia in accordance with claim 15 wherein said first rectangular shaped hard padding member and said second rectangular shaped hard padding member are made of hard paper boards.

18. A frame for sports memorabilia in accordance with claim 15 wherein said first rectangular shaped transparent window member and said second rectangular shaped transparent window member are made of glass.

* * * * *